US006018955A

United States Patent [19]

Kaneko et al.

[11] Patent Number: 6,018,955

[45] Date of Patent: Feb. 1, 2000

[54] AIR CONDITIONING AND FRONT PANEL THEREFOR AND METHOD AND APPARATUS FOR MAKING, USING, AND REINFORCING SAME

[75] Inventors: Takuji Kaneko; Yoshikatsu Okamoto, both of Osaka, Japan

[73] Assignee: Funai Electric Co., Ltd., Osaka, Japan

[21] Appl. No.: 09/028,049

[22] Filed: Feb. 23, 1998

[30] Foreign Application Priority Data

| | | | |
|---|---|---|---|
| Apr. 3, 1997 | [JP] | Japan | 9-085421 |
| Apr. 14, 1997 | [JP] | Japan | 9-002829 |
| Apr. 28, 1997 | [JP] | Japan | 9-111512 |
| Sep. 1, 1997 | [JP] | Japan | 9-236148 |

[51] Int. Cl.[7] ..... F24F 1/00

[52] U.S. Cl. ..... 62/125; 116/307

[58] Field of Search ..... 62/125, 126, 127, 62/129, 130, 262; 236/94; 165/11.1; 52/38; 116/200, 306, 307; 40/616

[56] References Cited

U.S. PATENT DOCUMENTS

| | | | |
|---|---|---|---|
| 3,410,105 | 11/1968 | Marsteller | 62/125 X |
| 4,240,264 | 12/1980 | Nakada et al. | 62/125 |

FOREIGN PATENT DOCUMENTS

| | | |
|---|---|---|
| 55-42743 | 9/1980 | Japan . |
| 62-13344 | 1/1987 | Japan . |
| 62-171823 | 10/1987 | Japan . |
| 63-19256 | 1/1988 | Japan . |
| 2-179787 | 7/1990 | Japan . |
| 6-155710 | 6/1994 | Japan . |
| 6-305859 | 11/1994 | Japan . |
| 7-63367 | 3/1995 | Japan . |
| 9-1776 | 1/1997 | Japan . |

*Primary Examiner*—Harry B. Tanner
*Attorney, Agent, or Firm*—Morgan, Lewis & Bockius LLP

[57] ABSTRACT

An air conditioner system including an air conditioner unit having a first operating mode in which the air conditioner unit is operated to effect one of cooling and heating, and a second operating mode in which the air conditioner unit is operated to effect the other of cooling and heating, the air conditioner system including a main body of the air conditioner unit, the main body comprising a casing accommodating a heat exchanger, a fan, and electrical parts; and a first graphic-bearing panel detachably fitted to the front surface of the main body of the air conditioner unit, the first graphic-bearing panel comprising a plurality of ribs forming slits penetrating from an obverse surface of the first panel to a reverse surface of the first panel, and displaying a first visual cue of one of coolness and warmth on the horizontal ribs, the first visual cue of the first graphic-bearing panel matching the effect provided by the first operating mode.

21 Claims, 17 Drawing Sheets

AIR CONDITIONING AND FRONT PANEL THEREFOR AND METHOD AND APPARATUS FOR MAKING, USING, AND REINFORCING SAME

BACKGROUND OF THE INVENTION

1. Field of the Invention

The present invention generally relates to an air conditioner for household use. In the case of a so-called separate type configuration in which separate indoor and outdoor units are provided, the present invention primarily relates to the indoor unit and a printing apparatus for its front panel. In the case of a so-called window type unit in which the indoor portion and the outdoor portion are accommodated in a common casing, the present invention primarily relates to the indoor portion and a printing apparatus for its front panel. More particularly, the present invention relates to a front panel which is detachably fitted to an indoor air conditioner unit or to the indoor portion of a window type unit as well as to a method and apparatus for printing on and using the front panel. Moreover, the present invention also relates to a method of reinforcing the front panel.

2. Discussion of the Related Art

With reference to FIG. 10, an indoor air conditioner unit 103 having a main body 101 of an air conditioner in which a heat exchanger, a fan, electrical parts, and the like are accommodated in its casing, as well as a front panel which is detachably and openably fitted to the front surface of the main body 101, is known.

Since the front panel 102 generally covers substantially the entire portion of the front surface of the air conditioner body, plural horizontal slits 104 are provided to allow air to circulate over the obverse and reverse surfaces of a major portion of the front panel. The horizontal slits 104 are formed in the front panel. Vertical ribs 106 are also formed at appropriate intervals to reinforce horizontal ribs 105. This front panel is normally made of a synthetic resin such as polypropylene (PP).

The above-described indoor air conditioner unit is fixed at a relatively high position on a wall surface of a room. Once it is installed, due to connection of a refrigerant pipe between the same and an outdoor unit and connection to a power supply, the air conditioner unit is kept semi-permanently fixed at the same place except at the time when the air conditioner is removed.

For this reason, difficulty in cleaning has occurred. In view of this, a product has recently been developed in which only the front panel portion, where dirt is particularly noticeable, is made detachable from the main body.

Thus, although the air conditioner (indoor unit) is an electrical product, it also has the character of a quasi-structure (such as a pillar or a transom), as well as the character of an article of the interior (i.e., an interior article). Consequently, in the case where the indoor air conditioner is viewed as an article of the interior, there is the following unsatisfactory aspect.

That is, a carpet, a curtain, and the like, can be cited as typical articles of the interior (of a home or office, for example). However, these articles are often changed, as if naturally, in correspondence with an annual seasonal cycle. In other words, during summer a curtain and a carpet for the summer season which provide a cool appearance are furnished, while during winter a thick curtain and a thick carpet having a warming effect for the winter season are used. These articles not only provide warming and cooling effects, but also are pleasurable to look at and enrich the user's living conditions.

Another example of a conventional indoor unit is shown in FIG. 15. The indoor unit of FIG. 15 is arranged such that a synthetic resin-made front panel 102 is fitted to the front surface of a main body 101 of the air conditioner unit. A blow port 101*a* is formed in the lower portion of main body 101. Plural slits 104 extending in the horizontal direction are formed in a panel body 103 of the front panel 102 in parallel at predetermined intervals for suction purposes. Front surfaces 105*a* of ribs 105 between the slits 104 are formed flush with a front surface 103*a* of the panel body 103. In FIG. 15, reference numeral 106 denotes a heat exchanger and reference numeral 107 denotes a fan. The conventional unit of FIG. 15 is subject to various, if not all, of the disadvantages discussed above with reference to FIG. 10.

SUMMARY OF THE INVENTION

Accordingly, the present invention is directed to a front panel of an air conditioner unit which substantially obviates one or more of the problems due to limitations and disadvantages of the related art. More particularly, in view of the above-described drawbacks, the present invention has succeeded in demonstrating the function of an air conditioner as an article of the interior in full measure by providing a design on the horizontal ribs of the front panel and by making use of the arrangement in which at least the front panel portion is detachable as described above. The present invention also provides a method for fabricating such a front panel. Additionally, the present invention compensates for the fact that the horizontal ribs are more flexible and therefore not as strong as other flat portions of the font panel, such that a printing method with a large pressing force may not be suitable. Specifically, the present invention compensates for this condition and allows a printing apparatus to finely print a design picture on only the horizontal ribs without spreading the printing to portions other than the ribs.

Of particular note, it is an object the present invention to provide an air conditioner having a novel front panel structure establishing visual cues to create psychological impressions of warmth, coolness, and the like. It is also an object of the invention to provide a front panel for an air conditioner and a method for reinforcing the front panel which makes it possible to simply attach a protective sheet only to the ribs of the front panel.

Additional features and advantages of the invention will be set forth in the description which follows and in part will be apparent from the description or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an air conditioner system includes an air conditioner unit having a first operating mode in which the air conditioner unit is operated to effect one of cooling and heating, and a second operating mode in which the air conditioner unit is operated to effect the other of cooling and heating, the air conditioner system comprising: a main body of the air conditioner unit, the main body comprising a casing accommodating a heat exchanger, a fan, and electrical parts; and a first graphic-bearing panel detachably filled to the front surface of the main body of the air conditioner unit, the first graphic-bearing panel comprising a plurality of ribs forming slits penetrating from an obverse surface of the first panel to a reverse surface of the first panel, and displaying a first visual cue of one of coolness and warmth on the horizontal ribs, the first visual cue of the first graphic-bearing panel matching the effect provided by the first operating mode.

In another aspect, a method of optionizing an air conditioner structure by periodically modifying the structure of the air conditioner based on environmental conditions, includes the steps of: selecting a first operating mode of the air conditioner, dependent upon ambient conditions, in order to effect one of cooling and warming; selecting a first graphic-bearing panel having a plurality of ribs forming slits penetrating from an obverse surface of the first panel to a reverse surface of the first panel, and displaying a first visual cue of one of coolness and warmth on the horizontal ribs of the first graphic-bearing panel, the selecting of the first operating mode and the first graphic-bearing panel being performed so that the first visual cue of the first graphic-bearing panel matches the effect provided by the first operating mode; disposing the first graphic-bearing panel on an externally visible portion of the air conditioner; selecting a second operating mode of the air conditioner, dependent upon ambient conditions, in order to effect the other of cooling and warming; selecting a second graphic-bearing panel having a plurality of ribs forming slits penetrating from an obverse surface of the second panel to a reverse surface of the second panel, and displaying a second visual cue of the other of coolness and warmth on the horizontal ribs of the second graphic-bearing panel, the selecting of the second operating mode and the second graphic-bearing panel being performed so that the second visual cue of the second graphic-bearing cover matches the effect provided by the second operating mode; and replacing the first graphic-bearing panel on the externally visible portion of the air conditioner with the second graphic-bearing cover.

In a further aspect, a front panel having an entire portion thereof formed of a resin molding and being configured to be detachably supported on a main body of an air conditioner comprises: a plurality of horizontal ribs forming slits penetrating from an obverse surface of the front panel to a reverse surface of the front panel; and a picture pattern physically printed on the horizontal ribs of the front panel.

In yet another aspect, a method of printing a picture pattern on a front panel configured to be detachably supported on a main body of an air conditioner, the front panel comprising a plurality of horizontal ribs forming slits penetrating from an obverse surface of the front panel to a reverse surface of the front panel, includes the steps of: disposing a transfer sheet bearing the picture pattern between the front panel and a heat transfer roller facing the horizontal ribs of the front panel; and bringing the heat transfer roller and the front panel into pressure contact and rolling the heat roller along the front panel so as to transfer the picture pattern on the transfer sheet to the front panel.

In a still further respect, a method of reinforcing a front panel for an air conditioner, the front panel comprising a panel body having a plurality of slits for suction disposed in parallel with one another at predetermined intervals on the panel body, comprises the steps of: forming the front panel such that front surfaces of ribs of the panel body located between the slits project slightly forward relative to a main front surface of the panel body, disposing a protective sheet in face-to-face relation to the front surfaces of the ribs of the panel body; and heat transferring the protective sheet to the front surfaces of the ribs by a heating and pressure-contacting process.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and are incorporated in and constitute a part of this specification, illustrate embodiments of the invention and, together with the description, serve to explain the principles of the invention. In the drawings.

DETAILED DESCRIPTION OF PREFERRED EMBODIMENTS

Figure 1:
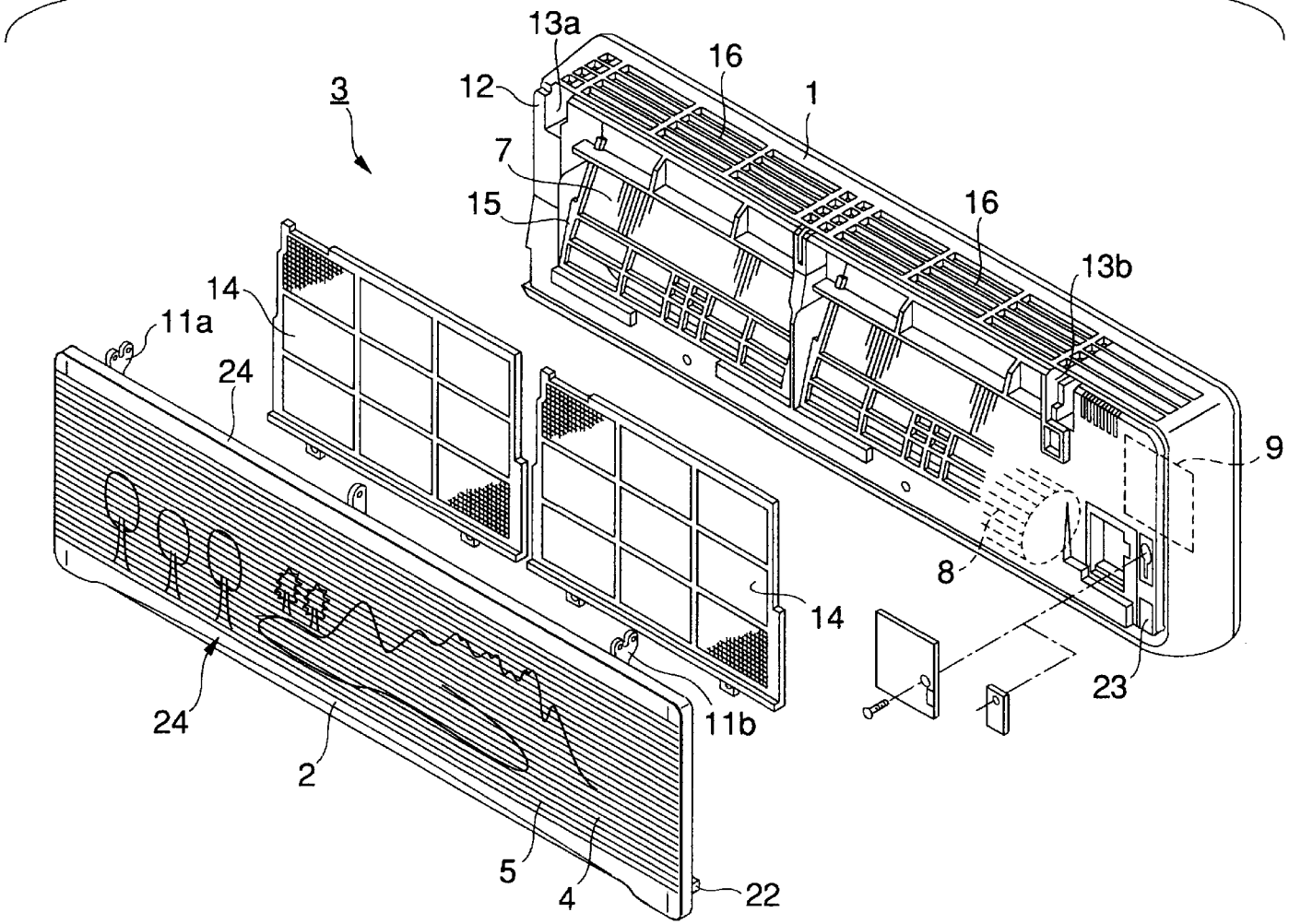
FIG. 1 is a perspective view illustrating a front panel and an overall air conditioner to which the front panel is fitted in accordance with an embodiment of the present invention.

Reference will now be made in detail to preferred embodiments of the present invention, examples of which are illustrated in the accompanying drawings. The same reference numerals are used to designate same or related objects throughout the various drawings.

FIG. 1 is an overall perspective view of an air conditioner (indoor unit) 3 to which the present invention is applied. This indoor air conditioner unit 3 comprises a main body in which a heat exchanger 7, a fan 8, electrical parts 9, and the like are accommodated, as well as a front panel 2 which is fitted and configured in such a manner as to cover substantially the overall front surface of the main body 1. The front panel 2 is an integrally molded item made of polypropylene, and is arranged such that hinge portions 11*a* and 11*b* formed projectingly from an upper side thereof are engageable with hinge receiving portions 13*a* and 13*b* formed on a casing 12 of the main body 1. As such, the front panel 2 is detachable and rotatable (openable) with respect to the main body 1.

Reference numeral 14 denotes a filter which is inserted along a guide portion 15 formed on the casing 12 and is fitted to the front of the heat exchanger 7. Reference numeral 16 denotes a plurality of slits for air suction which are formed on the upper surface of the casing.

Next, referring to FIG. 3, a description will be given with respect to the hinges 11*a* and 11*b* and the hinge receiving portions 13*a* and 13*b*.

Figure 3:
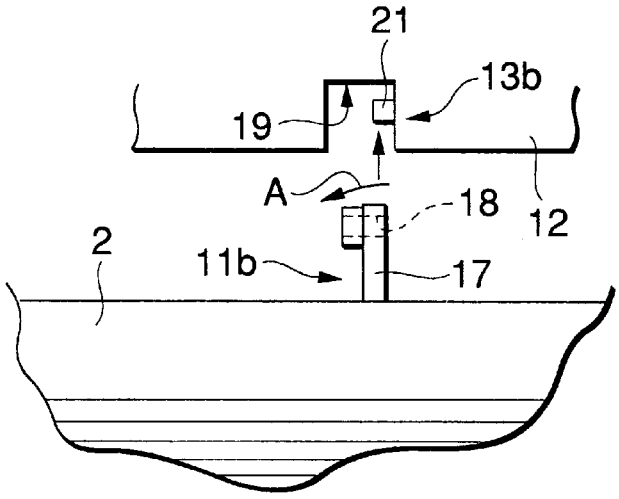
FIG. 3 is an explanatory diagram illustrating a hinge portion on the front panel and a hinge receiving portion on the main body.

With reference to FIG. 3, the hinge portion 11*b* is arranged such that an engaging hole 18 is formed in a plate-shaped portion 17 which is formed of a resin (polypropylene) integrally with the front panel 2. The hinge portion 11*b* can easily be deflected in the direction of arrow A in FIG. 3 by an appropriate force (e.g., a force exerted by a user).

With further reference to FIG. 3, the hinge receiving portion 13*b* has an engaging pin 21 which is projectingly formed in a recessed portion 19 formed in the casing 12 on the main body side.

Since the hinge portions 11*a* and 11*b* and the hinge receiving portions 13*a* and 13*b* are structured as described above, at the time when the user attaches or detaches the front panel 2 with respect to the main body 1, if the plate-shaped portions 17 of the hinge portions on both sides are deflected inwardly as shown in FIG. 3 (see also FIG. 1), the engaging holes 18 can easily ride over the engaging pins 21, and the two members can be engaged with or disengaged from each other. In the state in which the two members are engaged with each other, the front panel 2 becomes rotatable (openable) with respect to the main body 1 with the engaging pins 21 serving as the center of rotation.

Referring back to FIG. 1, reference numeral 22 denotes an engaging portion which is projectingly formed on a lower side of the front panel 2. This engaging portion 22 engages in and with a lock portion 23 on the main body 1 side to maintain the front panel 2 in the closed state.

Next, a more detailed description will be given of the structure of the front panel 2.

Figure 4A:
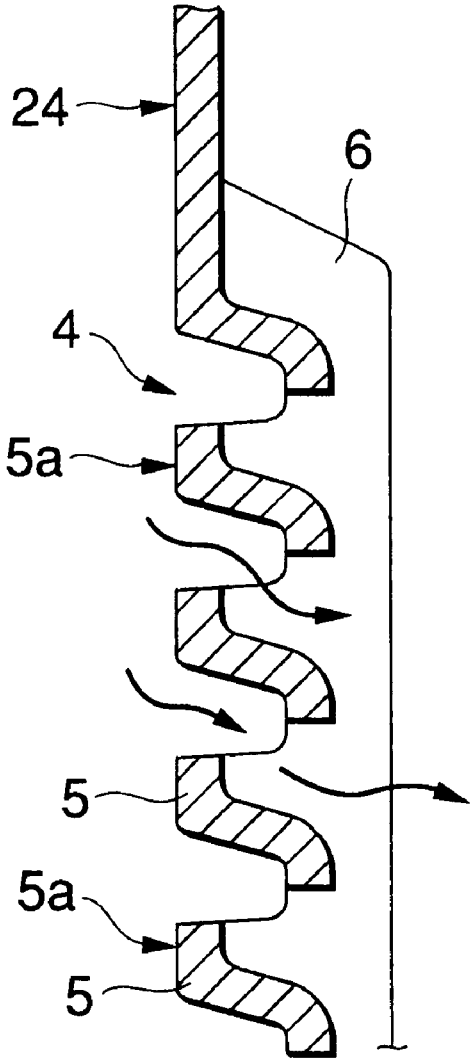
FIG. 4, including FIGS. 4(*a*)–4(*c*), is an enlarged cross-sectional view, taken along line IV—IV of FIG. 2, of portions of horizontal ribs of the front panel.
Figure 4B:
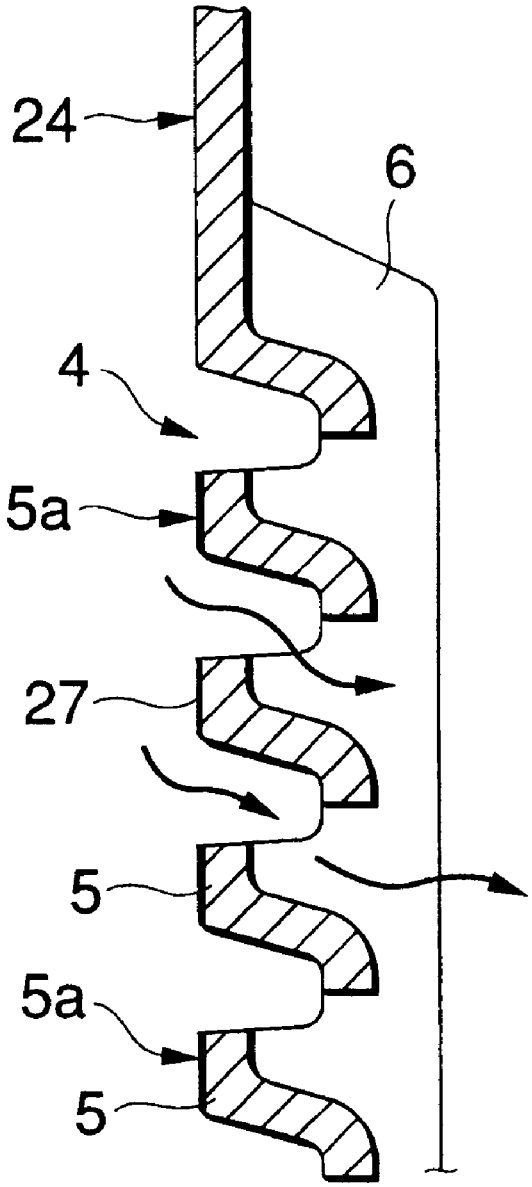
Figure 4C:
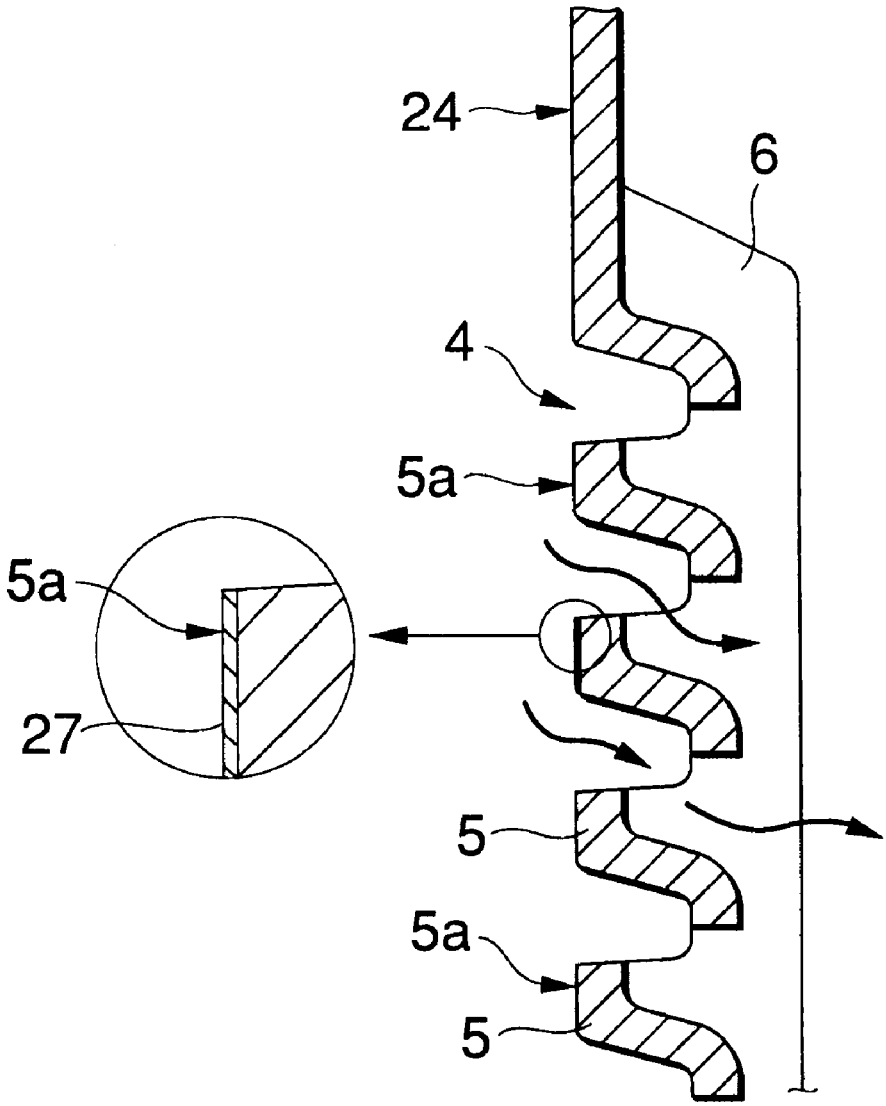

With reference to at least FIGS. 1 and 4, plural slits 4 are formed on the overall surface of the front panel 2 to allow air to circulate over the obverse and reverse surfaces of the panel. The plural slits 4 are essentially shown in their entirety in FIG. 1 and are partially shown in sectional fashion in FIG. 4 (i.e., FIGS. 4(*a*), 4(*b*), and 4(*c*)). These slits 4 are formed by forming plural horizontal ribs 5, each having a substantially L-shaped cross section as shown in FIG. 4, in front panel 2. The arrangement provided is such that air flows to the reverse side of the panel, i.e., to the main body 1 side of the air conditioner, bending from a slightly upper position along the horizontal ribs 5.

Reference numeral 6 denotes vertical ribs which are provided at appropriate intervals along the front panel 2.

The plural horizontal ribs 5 are relatively narrow, as described above, and are easily deflected. Thus, if a strong force is applied thereto, the ribs 5 are likely to break. For example, in the case where the front panel 2 is detached for washing with a cleanser, the ribs are pressed with a larger force per unit area than the other flat portions 24 of the panel surface, even if the same overall force is applied. Moreover, the ribs tend to receive defects such as scratches.

In addition, since air circulates as described above, dust in the room is liable to accumulate at portions where the flow rate of air weakens and near the horizontal portions of the ribs.

Figure 2:
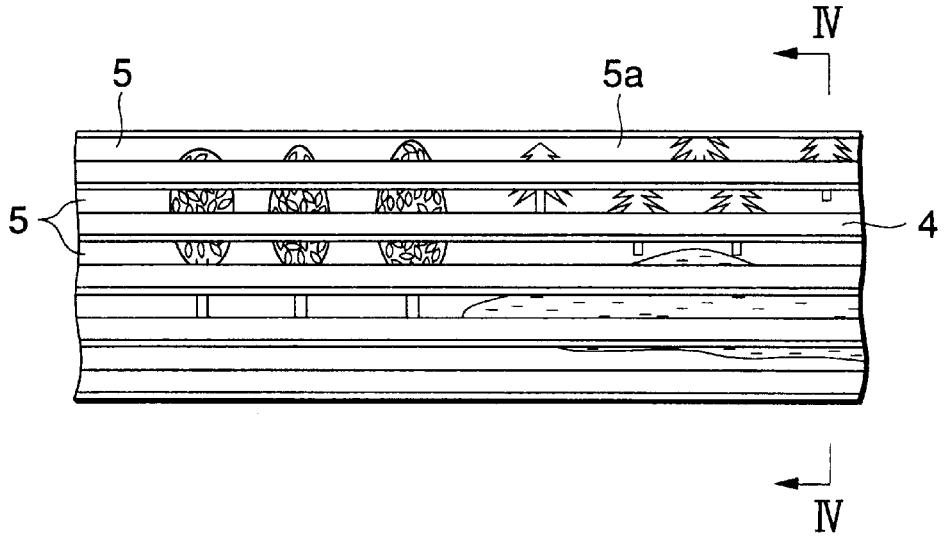
FIG. 2 is a front elevational view of a portion of the front panel.

In this embodiment, as shown in FIGS. 2 and 4, the cross section of each horizontal rib 5 is formed in a rectangular shape having a flat portion 5*a* which is flush with (in the same plane as) a panel surface 24 of the front panel 2 other than the portions corresponding to the horizontal ribs 5. The arrangement provided is such that a designed or designated picture 27 can be easily printed on these flat portions 5*a* by a printing method which will be described in further detail below.

Thus, a designed picture is provided on the horizontal ribs 5, particularly on the aforementioned flat portions 5*a* thereof, as shown in enlarged form in FIG. 2.

The pattern of the design may be arbitrarily selected. Preferably, as described in greater detail below, the design is selected to provide a structure establishing a visual cue to create a psychological impression to the user such as warmth, coolness, or the like. The design is printed by a method which will be described below. Preferably, the design is not provided on the panel surface 24 but rather only on the horizontal ribs 5.

Next, a description will be given of a method of printing the above-described designed picture.

Figure 5A:
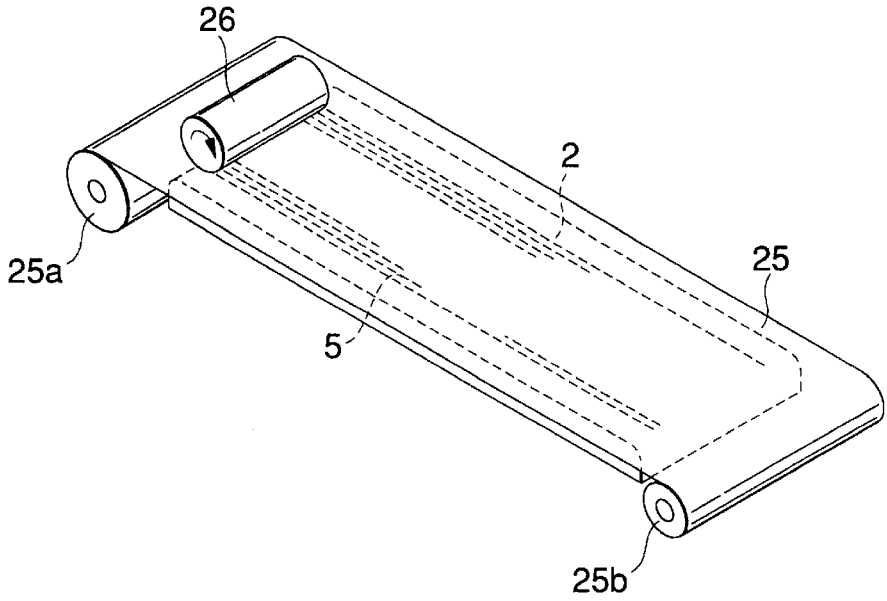
FIG. 5, including FIGS. 5(*a*) and 5(*b*), is a schematic diagram illustrating a method and printing apparatus for printing on the front panel in accordance with a first embodiment of the invention.
Figure 5B:
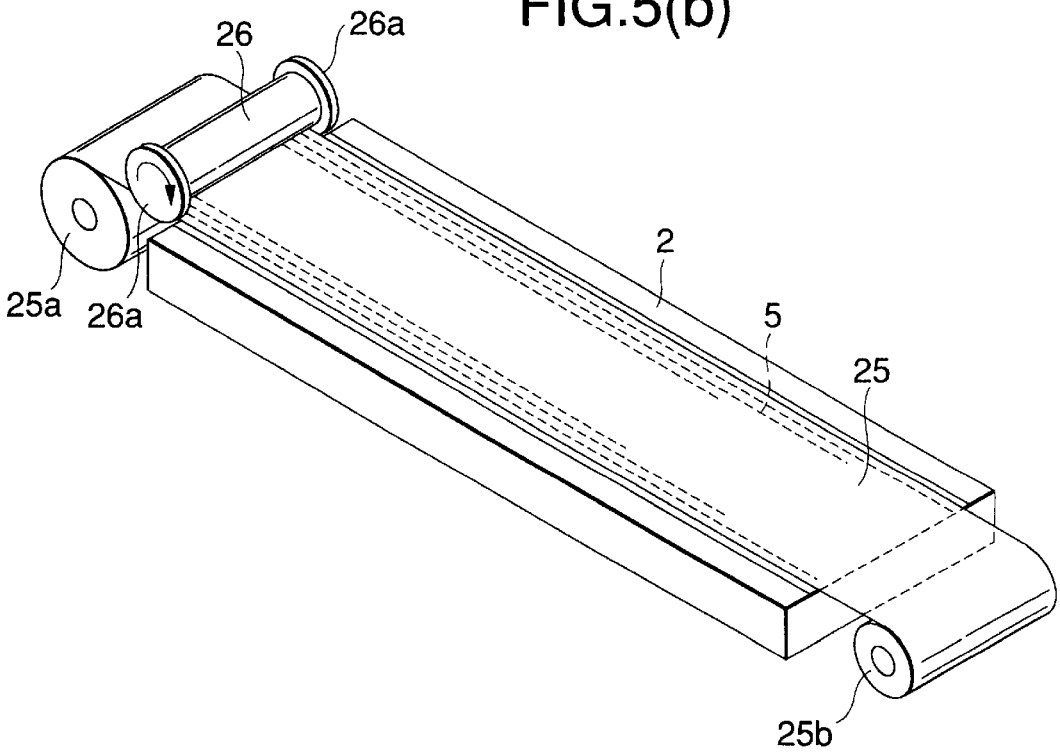
Figure 6A:
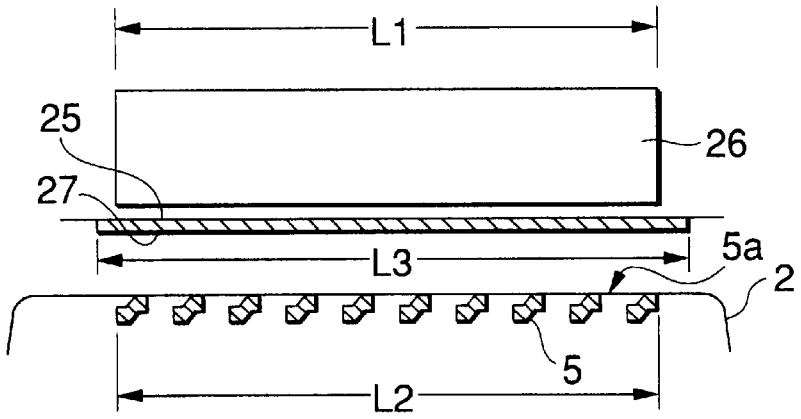
FIG. 6, including FIGS. 6(*a*) and 6(*b*), is a cross-sectional view illustrating a positional relationship among the front panel, a transfer sheet, and a heat transfer roller.
Figure 6B:
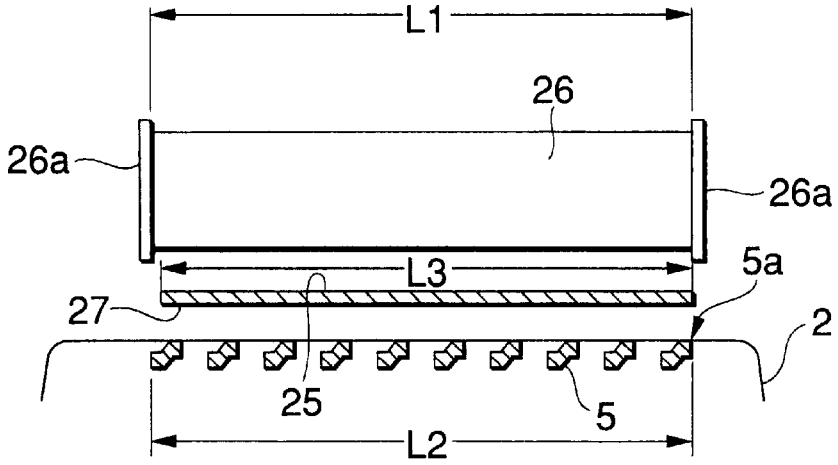

Namely, in this embodiment, an apparatus is used in which, as shown in FIG. 5(*a*), a transfer sheet 25 is disposed over a horizontally positioned front panel 2 which has not yet been provided with a design. In this position, a heat transfer roller 26 is rollably disposed above the transfer sheet 25. The transfer roller 26 is capable of coming into pressure contact with a lower position, i.e., in a direction toward the front panel 2, and is arranged to be rotatable. A desired design (pattern) 27 is provided in advance on the lower surface of the transfer sheet 25 in a state of being painted or otherwise covered all over without having blank portions corresponding to the slits of the front panel (FIG. 6(*a*)).

It should be noted that the transfer sheet 25 is arranged to be fed from a feed roll 25*a* onto the front panel 2 by a desired length for each printing. Numeral 25*b* denotes a takeup roll. In addition, the length L1 of the aforementioned heat transfer roller 26 is set to be identical to the range L2 in which the horizontal ribs 5 are present.

Variations of the configurations of FIGS. 5(*a*) and 6(*a*) are shown in FIGS. 5(*b*) and 6(*b*), respectively. As shown in FIGS. 5(*b*) and 6(*b*), flange portions 26*a* may be provided at both ends of roller 26 so as to engage with the horizontal ribs 5. In at least this case, the width L3 of the transfer sheet 25 may be slightly smaller than the length L1 of the transfer sheet roller 26.

Next, a description will be given of the printing method using the above-described apparatus.

Namely, the transfer sheet 25 on the lower surface of which a desired design (pattern) is painted (printed) in advance is fed onto the front panel 2 as described above. The heat transfer roller 26 is then rolled on the transfer sheet 25 while being brought into pressure contact with the lower position.

At this time, since the length L1 of the heat transfer roller 26 is set to be identical to the range L2 of the horizontal ribs 5, even if the pattern 27 on the transfer sheet 25 has a width L3 which exceeds the range of the horizontal ribs 5, insofar as the placing position of the front panel 2 is set accurately (by using an appropriate jig), the design is transferred onto only the portions of the horizontal ribs 5, and does not jut out to the other portions.

Furthermore, even if the design on the transfer sheet 25 is a solidly painted design, the portions to which the design is transferred correspond only to the flat portions 5*a* of the horizontal ribs 5. Nonetheless, the transferred design (FIG. 2) on the surfaces of the horizontal ribs 5 is transferred from the design 27 which was originally provided on the transfer sheet 25 in an integrated form as one picture as a whole, so that, although the portions of the slits 4 are blank, the transferred design forms one completed design as seen from a distant view (FIG. 2). The completed design as viewed from a distance can also be understood with reference to FIG. 1.

Accordingly, on the transfer sheet 25 after the transfer, only those design portions that correspond to the portions of the slits 4 are left or remain in stripe form. In addition, the design on the flat portions 5*a* forms a coating layer 27 and thereby protects the surface of the horizontal ribs. The coating layer 27 can be seen, for example, in FIG. 4(*b*), which is a variation of FIG. 4(*a*) showing the position of the location of the coating layer, and in FIG. 4(*c*), which is a variation of FIG. 4(*b*) showing a close-up of the coating layer 27.

Next, a description will be given of a second embodiment of a printing apparatus according to the present invention, for printing the above described design.

Figure 7:
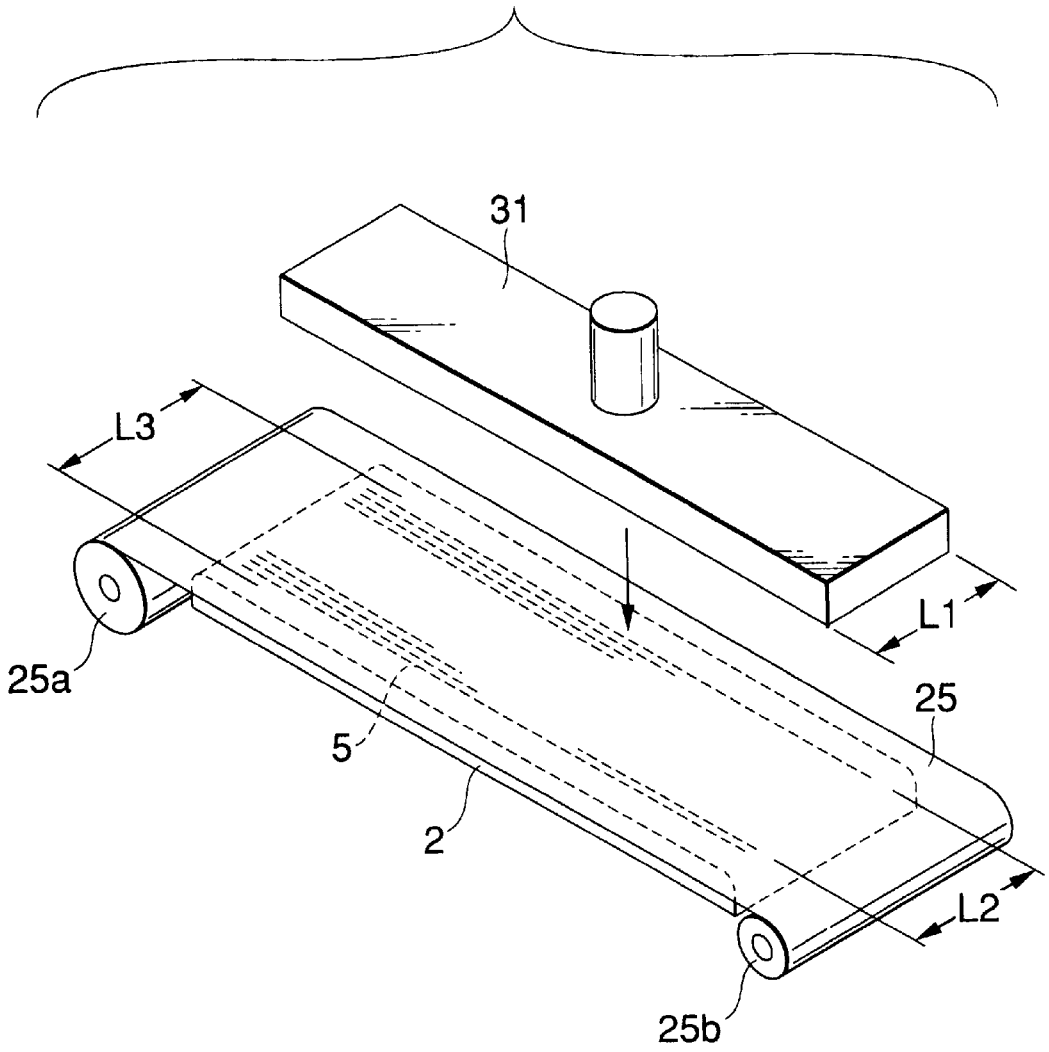
FIG. 7 is a schematic diagram illustrating a method and printing apparatus for printing on the front panel in accordance with a second embodiment of the invention.

As shown in FIG. 7, the printing apparatus of the second embodiment has, instead of the heat transfer roller 26 of the above described first embodiment, a heat pressing plate 31 that is vertically movable toward the front panel 2 mounted on the printing apparatus. The other parts and portions of the printing apparatus of the second embodiment are similar to those of the first embodiment, and the same reference numerals are assigned to the corresponding parts and portions in the descriptions and drawings relating to these embodiments.

In addition, for at least the second embodiment, the length L1 of the aforementioned heat pressing plate 31 is set to be identical to the range L2 in which the horizontal ribs 5 of the front panel 2 are present.

Next, a description will be given of a method of printing via the printing apparatus of the second embodiment described above.

The transfer sheet 25, which has a desired design or pattern painted or printed on its lower surface in advance, is fed from the feed roll 25*a* so that it is adjacent (e.g., over or on) the front panel 2. After positioning, the heat pressing plate (31) is moved downward, and applied with an appropriate pressing force.

At this time, since the length L1 of the heat pressing plate 31 is set to be identical to the range L2 of the horizontal ribs 5, even if the pattern 27 on the transfer sheet 25 has a width L3 which exceeds the range of the horizontal ribs 5, insofar as the placing position of the front panel 2 is set accurately (by using an appropriate jig), the design is transferred onto only the portions of the horizontal ribs 5, and does not jut out to the other portions.

In this second embodiment, the lower surface of the heat pressing plate 31, namely, the surface which will press against the front panel 2, may be configured to match the surface of the front panel 2. For instance, the lower surface of the heat pressing plate 31 may have a flat surface if the front panel 2 has a flat surface. On the other hand, if the front panel 2 is slightly convex, the pressing surface of the heat pressing plate 31 may be configured to be slightly concave.

Next, a description will be given of a third embodiment of a printing apparatus according to the present invention, for printing the above described design.

Figure 8:
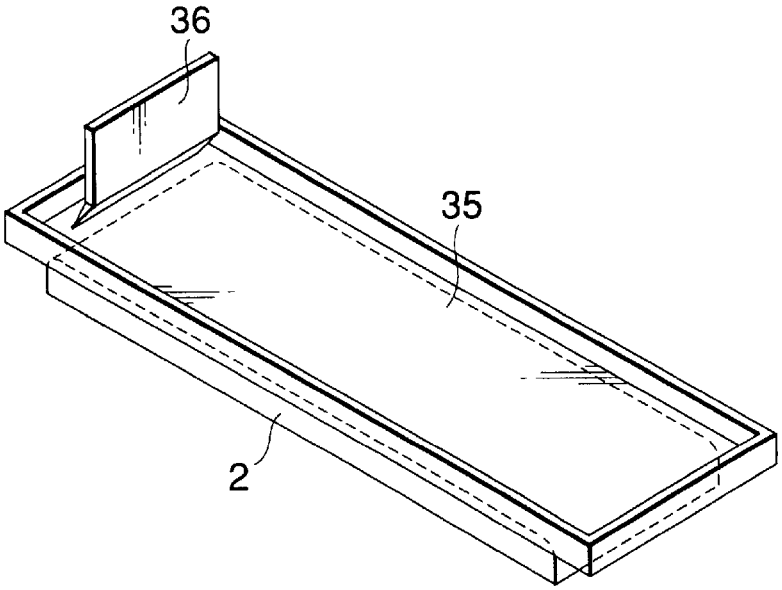
FIG. 8 is a schematic diagram illustrating a method and printing apparatus for printing on the front panel in accordance with a third embodiment of the invention.
Figure 9:
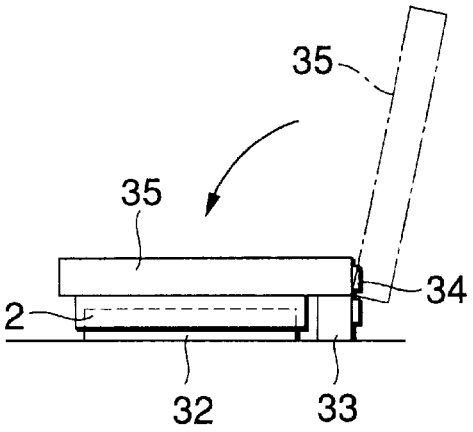
FIG. 9 is a side view of the printing apparatus of the third embodiment.
Figure 10:
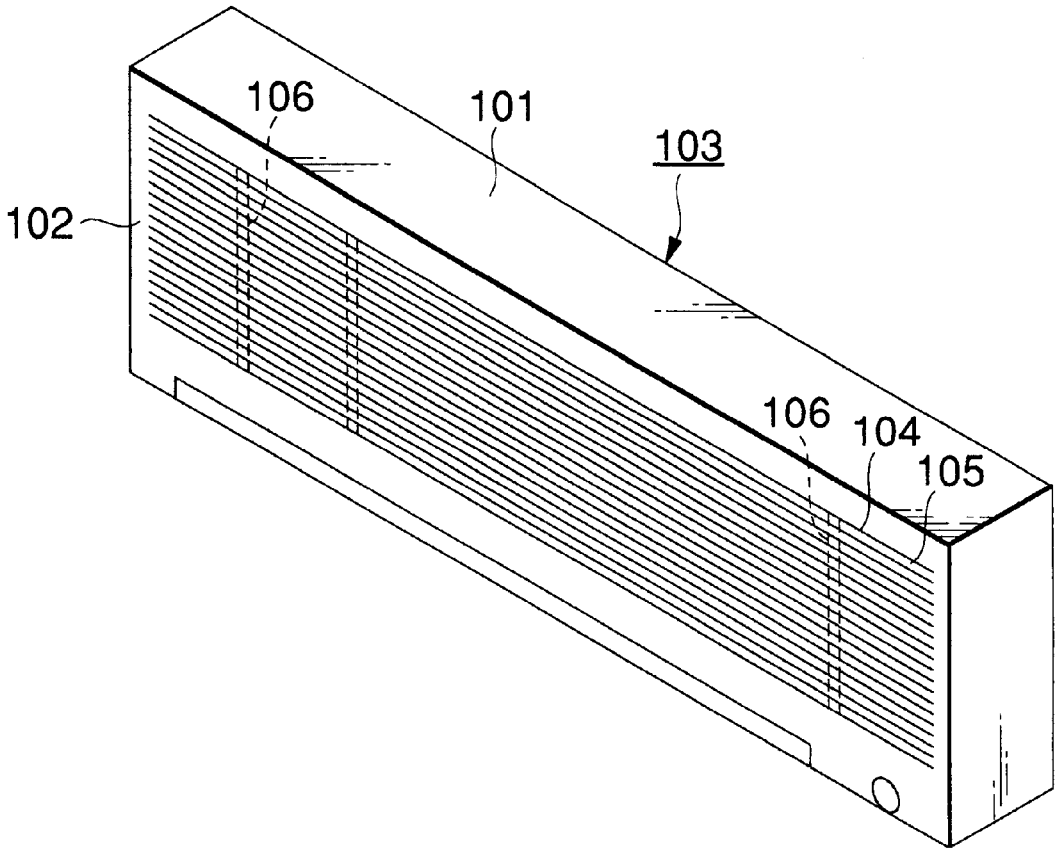
FIG.10 PRIOR ART
FIG. 10 is a perspective view illustrating a conventional air conditioner (indoor unit)

As shown in FIGS. 8 and 9, the printing apparatus of the third embodiment includes a positioning jig (fixing unit) 32 for positioning the front panel 2 on which a design has yet to be printed; a silk screen 35 which is pivotally connected to a base 33 using a hinge 34, the base being secured at a side portion of the positioning jig 32; and a squeeze or squeegee 36 which moves along the silk screen 35.

Next, a description will be given of a printing method with the printing apparatus of the third embodiment described above.

The desired design (pattern) is provided in advance on the silk screen 35. The front panel 2 is set in the positioning jig 32 to position the front panel 2. Then, the silk screen 35 is placed over the front panel 2 so as to cover it (as can be understood by the chain line to solid line movement of FIG. 9), and appropriate inks (painting agents) are applied to the silk screen 35. Next, the squeeze 36 is horizontally moved to print the design on the flat portions 5*a* of the horizontal ribs 5.

The above mentioned process is preferably repeated for each of four colors (yellow, magenta, cian, and black), namely, four times, to provide a full-color design if so desired.

In this third embodiment, in order to print on only the width of the horizontal ribs 5, the width of the design applied to the silk screen 35 is set to be identical to or smaller than the range L2 of the horizontal ribs.

Next, a description will be given of a method of using the front panel 2 provided with the design on the horizontal ribs 5 in the above-described manner.

Namely, since the front panel 2 can be easily attached to or detached from the main body 1 of the air conditioner as described above, the front panel 2 which is provided with a design of a scene which brings to mind a cool temperature, for example, is installed during summer (when the air conditioner is used for cooling), while during winter (when the air conditioner is used for warming) the front panel 2 is changed to one which is provided with a design that gives one viewing the front panel a warm feeling.

Thus, a structure is provided which establishes visual cues to impart a psychological impression such as warmth, coolness, or the like, with the front panel being replaceable depending on the mode of the unit as selected in accordance with seasonal conditions. In this manner, the front panel may be replaced with another panel having a different picture depending upon current seasonal and/or weather or other ambient conditions conditions.

As an example, in the winter when the unit functions as a heater for warming the room, a front panel having a picture of a fireside scene or the like will be used. This is intended to make persons in the room feel warmer than they would if only a blank or white front panel were used. As such, the front panel depicting a warm scene constitutes structure which performs the function of augmenting the effect of the current mode (e.g., warming) selected by the user by imparting a psychological impression of warmth to the user.

As another example, in the summer when the unit functions as a cooling air conditioner for cooling the room, the fireside or other warm scene panel is removed and replaced with a scene, such as a snow-capped mountain scene, lakeside panorama, windsurfers, sailboards, or boardsailors at the ocean, or the like, imparting a sense of coolness to the user. This is intended to make persons in the room feel cooler than they would otherwise. As such, the front panel depicting a cool scene constitutes structure that performs the function of augmenting the effect of the mode (e.g., cooling) selected by the user by imparting a psychological impression of coolness to the user.

Thus, the air conditioner unit of the present invention incorporates a front panel that not only depicts scenes of interest to the user, but also enhances the function of the unit by augmenting whichever mode, warming or cooling, is currently selected by the user. Such enhancement results at least in part from the novel relation between the depicted scene and the physical structure of the front panel and other portions of the air conditioner unit. Moreover, the novel structure of the design transferred onto the front panel serves to strengthen the panel due to the additional physical support provided by the design pattern itself. That is, the front panel is made physically stronger, and therefore less susceptible to breakage, upon and due to transference of the design pattern thereon.

In view of the foregoing, the following method of using the air conditioner of the present invention is contemplated. First, depending on season and/or weather or other ambient conditions, the user determines a first operating mode (cooling or heating) to be selected and a matching front panel (cool scene or warm scene) which will enhance the selected mode. The user may either attach the selected front panel first (e.g., selecting a first graphic-bearing cover displaying visual cues of coolness and disposing the first cover on a visible exterior portion of the unit) and then activate the selected operating mode (e.g., cooling), or vice versa.

Thereafter, when season and/or weather or other ambient conditions change (such as the arrival of winter), the user may determine a second operating mode (heating or cooling) to be selected and a matching front panel (warm scene or cool scene) which will enhance the selected mode. The user may either replace the first cover with the second cover first (e.g., selecting a second graphic-bearing cover displaying visual cues of warmth and disposing the second cover on a visible exterior portion of the unit) and then activate the selected operating mode (e.g., heating), or vice versa. When conditions change once more (e.g., the return of summer), the entire process may be repeated as necessary.

Consistent with the foregoing, the front panel 2 may be provided with a character (from an animation, for instance) or a design (a design showing one or more penguin characters, for example) which will please children and will be attached to an air conditioner which is installed in a children's room, for instance.

Furthermore, the front panel 2 may be provided with a design or a picture (a picture showing sports, for example) which will please young people and will be attached to an air conditioner which is installed in a young people's room, for instance.

Still further, with respect to an air conditioner which is installed in a room having an European atmosphere, the front panel 2 may be provided with a painting (a painting of an European landscape, for instance).

Still further, the front panel 2 may be provided with a character or a design (a design showing flowers, for example) which will please females and will be attached to an air conditioner which is installed in a females' room, for instance.

Furthermore, the front panels provided with various different designs may be marketed and circulated as separate air conditioner unit components (peripherals) so that the above-described change can be effected more often and with greater flexibility. This will provide users with numerous options of scenes for display, flexibility, and thus make it possible to comply with the variety of desires, demands, and needs of users.

As described above, in accordance with the present invention, it is possible to provide a front panel in which a design is provided on only the horizontal rib portion, and to enhance the function of the air conditioner as an article of the interior of a living or working space, thereby enriching the user's living and/or working conditions.

In addition, although dust and the like are likely to attach to the portions of the horizontal ribs during use in the manner described above, the effect of this phenomena is decreased by the present invention in that the dust and stains become less noticeable due to provision of the designed picture.

Further, if a resin reinforcing agent is mixed in ink which is transferred to or painted on the horizontal ribs by printing, it is possible to increase the physical strength of the horizontal ribs. In the absence of such design transfer, the horizontal ribs will have a relatively low physical strength.

Moreover, if the horizontal ribs incur stains thereon such that the front panel must be detached for cleaning with water or a cleaning agent, as described above, the design thus transferred serves as a coating layer (i.e., a protective layer). The coating layer protects the horizontal ribs from scratches even in the case where brushing for cleaning purposes is applied with a strong force. Such protection is particularly effective because the horizontal ribs tend to receive a high pressure force per unit area as compared to the surface 24 of the front panel 2 excluding the ribs, thereby rendering the ribs especially susceptible to scratches in the absence of the protective coating.

Furthermore, in accordance with the printing method of the present invention, a visually pleasing and warmth or coolness-imparting design can be printed accurately and speedily on the portions of the horizontal ribs of the air conditioner front panel.

Another aspect of the air conditioner of the present invention will now be discussed with reference to FIGS. 11–14, 16 and 17.

As discussed above, conventional air conditioner units have not placed any emphasis on enhancing the appearance of the air conditioner units in order to impart visual cues which create psychological impressions of warmth or coolness to thereby augment the effect of the mode (warming or heating) selected by the user. Also, as noted above, the present inventors have proposed and disclose herein and elsewhere (e.g., Priority Japanese Patent Application No. Hei 09-085421) an embodiment intended to overcome this disadvantage.

Figure 16:
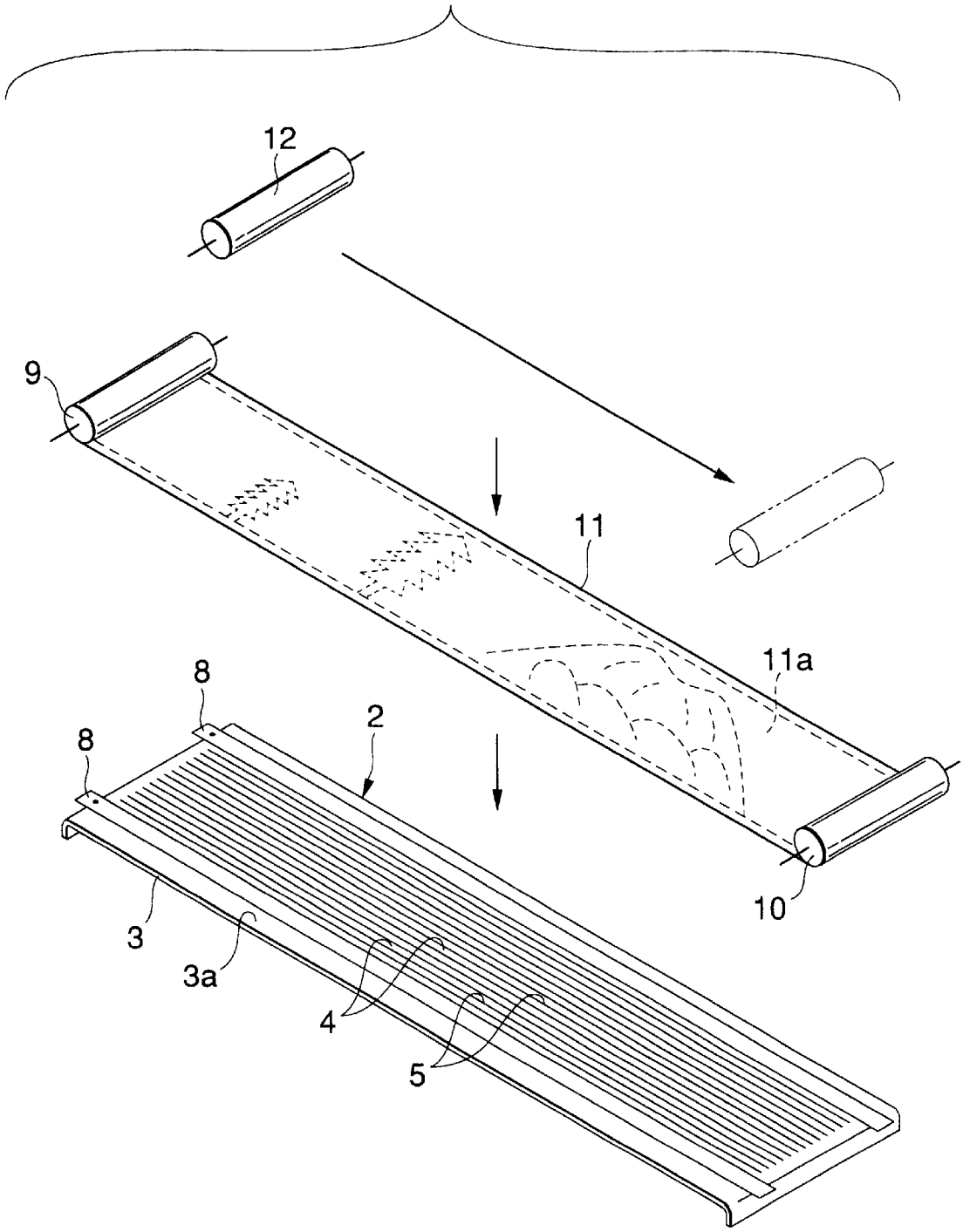
FIG. 16 is an exploded perspective view illustrating a method of reinforcing the front panel.
Figure 17A:
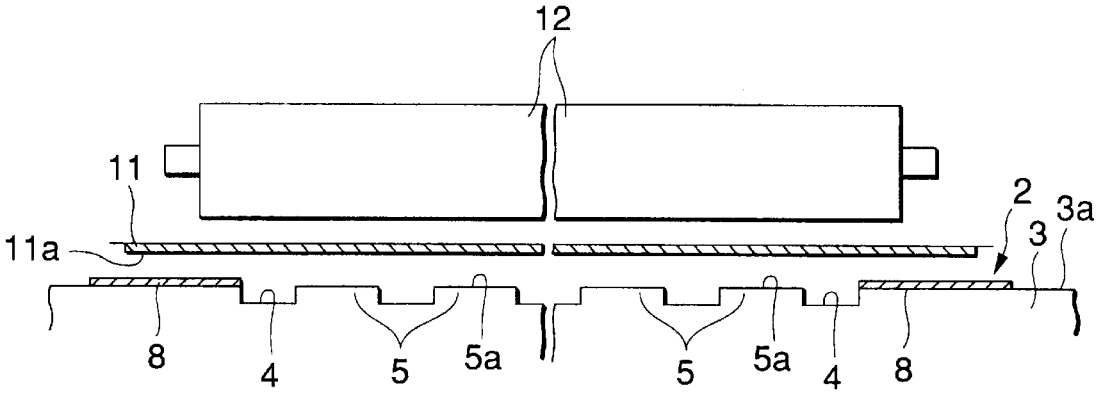
FIGS. 17(*a*)–17(*c*) are schematic side elevational views illustrating a procedure of the reinforcing method.
Figure 17B:
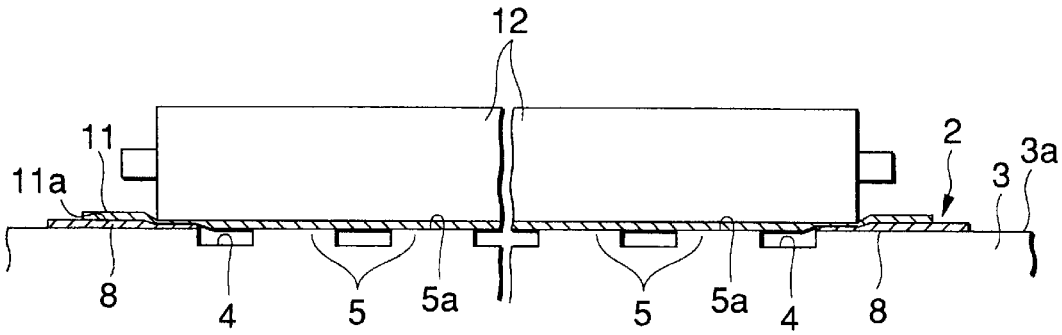
Figure 17C:
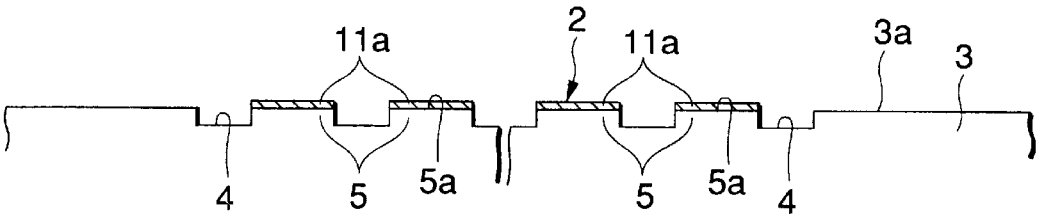

An embodiment of this type can be understood from FIGS. 16 and 17, for example. In FIGS. 16 and 17(*a*), a pair of trimming masks 8 made of an adhesive tape are attached to the front surface 3*a* of a panel body 3 along the slits 4 at upper and lower ends. Also, a release paper 11, stretched between a supply reel 9 and a takeup reel 10, is made to oppose the front surface 3*a* of the panel body 3. Then, as shown in FIG. 17(*b*), a heated heat transfer roll 12 is pressed against the front surface 3*a* of the panel body 3 via the release paper 11, and is rolled thereon, thereby allowing a pattern-incorporated protective sheet 11*a* on the release paper 11 to be heat transferred to the front surfaces 5*a* of the ribs 5. Subsequently the release paper 11 is released from the front surface 3*a* of the panel body 3, and the masks 8 are released from the front surface 3*a* of the panel body 3, thereby decorating the front surfaces 5*a* of the ribs 5 with the pattern-incorporated protective sheet 11*a,* as shown in FIG. 17(*c*).

In the above-described arrangement of FIGS. 16 and 17, the front surfaces 5*a* of the ribs 5 between the slits 4 are formed flush with the front surface 3*a* of the panel body 3, and the trimming masks 8 are attached to the front surface 3*a* of the panel body 3 to prevent the pattern from becoming heat transferred to the front surface 3*a* of the panel body 3. In this arrangement, however, it can be troublesome to adhere and release the masks 8. Also, the number of processes can increase, thereby increasing manufacturing and production costs.

In view of these potential disadvantages, the present inventors have come up with an improvement whereby, in the case where the protective sheet is being heat transferred to the ribs, the protective sheet can simply be heat transferred to the ribs by facing the sheet toward the front surface of the panel body, and then merely pressing the protective sheet against the front surfaces of the ribs by a heating and pressure-contacting device. As discovered by the present inventors, this process can be accomplished by configuring the front panel so that the front surfaces of the ribs between the slits project slightly forward relative to the front surface of the panel body, and so that the protective sheet can be simply attached only to the front surfaces of the ribs by heat transfer or the like. Since it is not necessary to use trimming masks in connection with this type of embodiment, the number of manufacturing processes can be reduced and production costs lowered.

Figure 11:
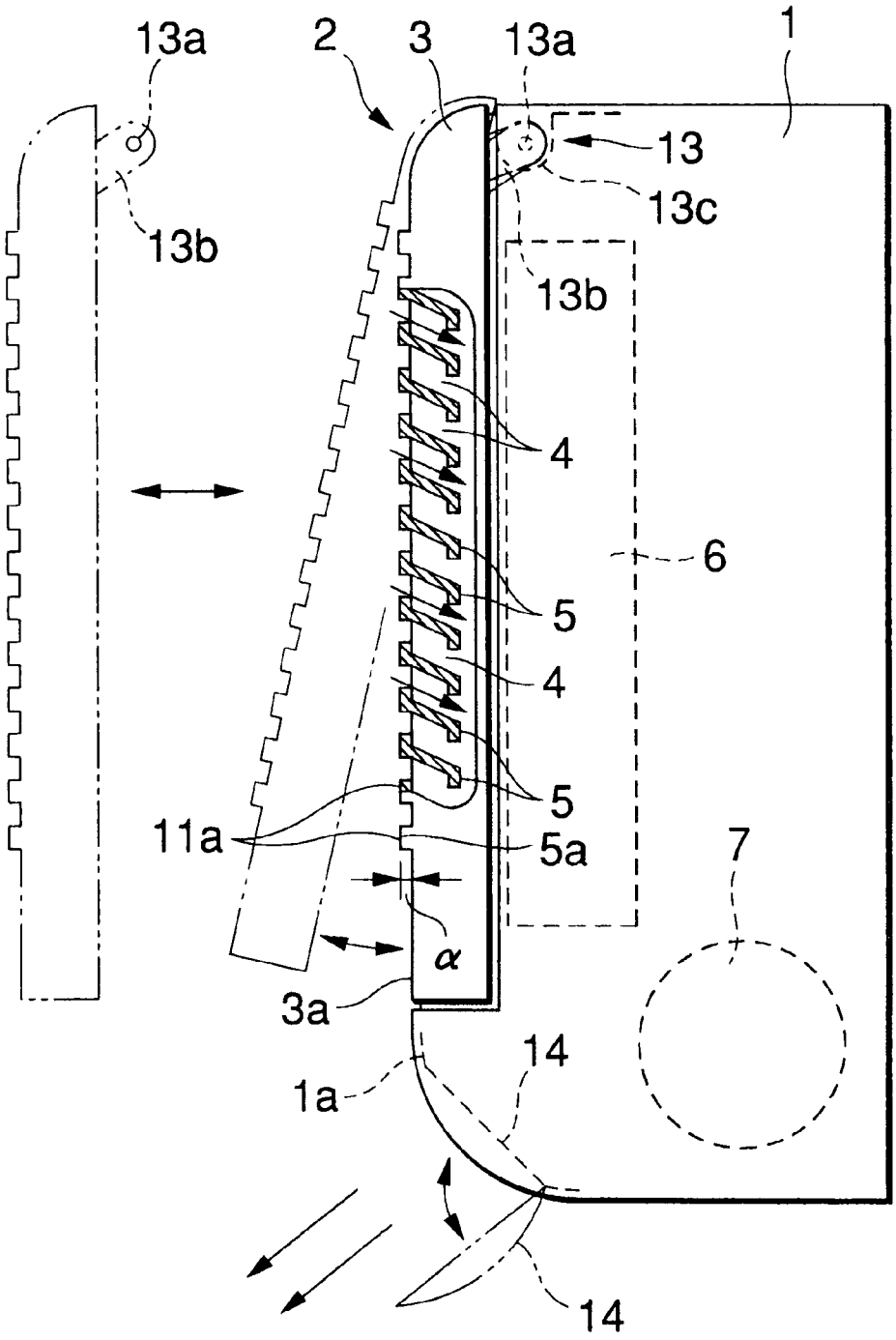
FIG. 11 is a partly fragmentary side elevational view illustrating an indoor unit of an air conditioner to which a front panel in accordance with an embodiment of the present invention is fitted.
Figure 12:
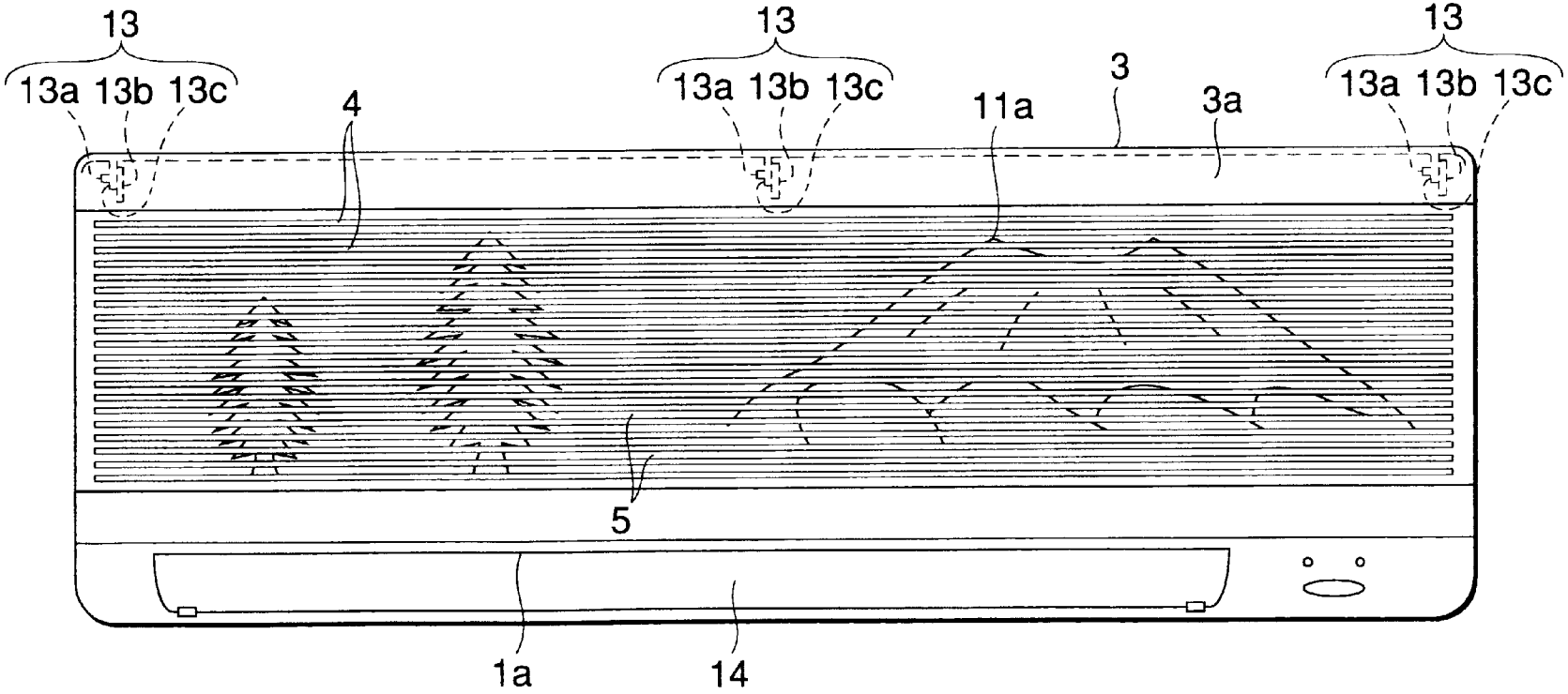
FIG. 12 is a front elevational view of the air conditioner unit depicted in FIG. 11.
Figure 15:
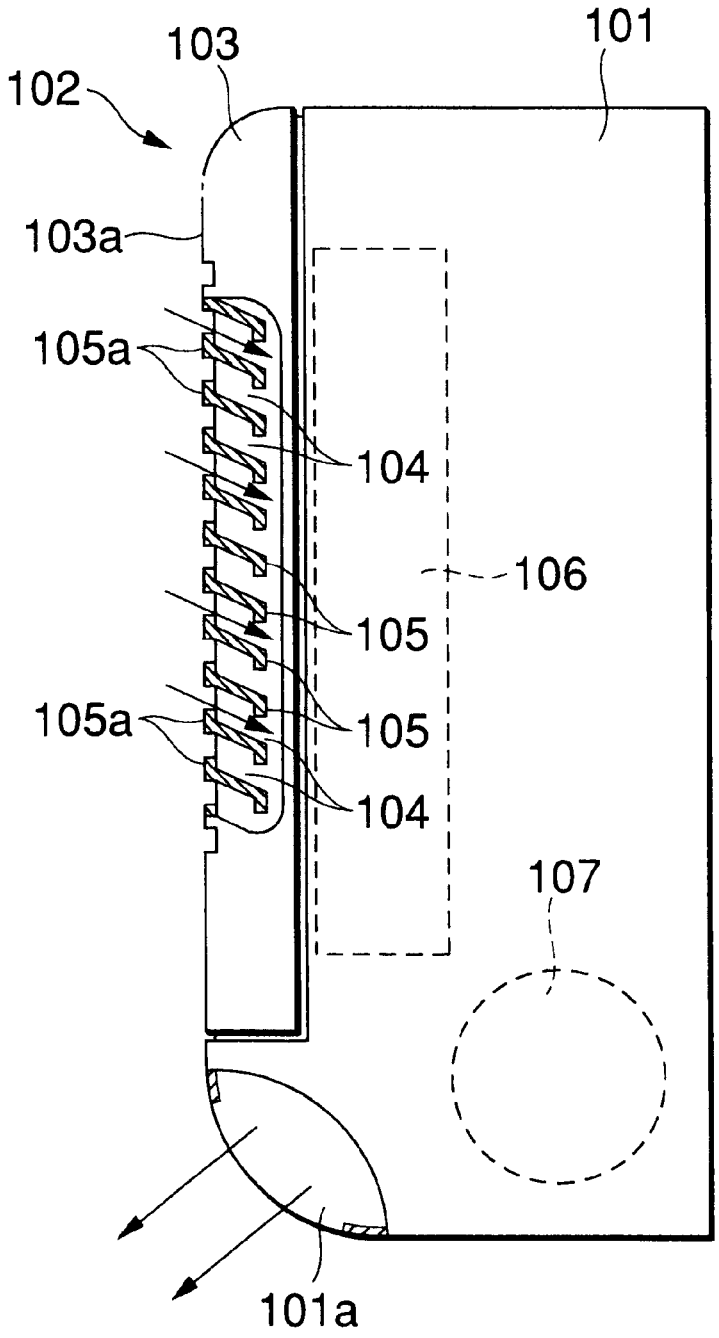
FIG.15 PRIOR ART
FIG. 15 is a partly fragmentary side elevational view of a conventional indoor unit.

A description of an embodiment of the present invention allowing the attainment of the aforementioned advantages will now be discussed with reference to FIGS. 11 and 12. FIGS. 11 and 12 show an indoor unit of an air-conditioner to which a front panel 2 in accordance with an embodiment of the present invention is attached. Front surfaces 5*a* of ribs 5 of the front panel 2 project slightly forward by a predetermined interval (e.g., 0.2–0.3 mm or thereabout) relative to a front surface 3*a* of a panel body 3. A protective sheet 11*a* is heat transferred to the front surfaces 5*a* of the ribs 5. An upper rear end of the front panel 2 is attached to an upper portion of a main body 1 of the air-conditioner via hinges 13. It should be noted that reference numeral 14 denotes an openable cover which is provided at a blow port 1*a*, and is opened when air is blown. Among the components other than those described above, the same parts as those shown in FIG. 15 will be denoted by the same or similar reference numerals such that a description thereof is not deemed necessary.

The aforementioned protective sheet 11*a* is formed by a sheet made of a synthetic resin, such as polypropylene, excelling in mechanical strength, and a figure (design) is printed thereon.

In accordance with the above-described arrangement, by virtue of the figure provided on the protective sheet 11*a*, the front panel 2 can be used as an article of the interior of a room. Also, when the ribs 5 are cleaned with a brush or the like, the front surfaces 5*a* of the ribs 5 can be protected from becoming scored or damaged.

As shown in FIGS. 11 and 12, each of the hinges 13 comprises a projection 13*b* having a pivot shaft 13*a* and projecting on an upper end of the reverse surface of the panel body 3 at predetermined intervals with respect to others of the projections, as well as a hook portion 13*c* formed on the front surface of the main body 1 of the air conditioner in face-to-face relation with a respective pivot shaft 13*a*. As the pivot shafts 13*a* are respectively engaged with the hooks 13*c,* the front panel 2 can be rotatably fitted to the main body 1 of the air-conditioner via the hinges 13 (see the two-dotted dash lines in FIG. 11). As the pivot shafts 13*a* are respectively disengaged from the hooks 13*c,* the front panel 2 can be removed from the main body 1 of the air-conditioner (see the single-dotted dash lines in FIG. 1).

In accordance with the above-described arrangement, if for example, a plurality of kinds of front panels 2 for spring, summer, fall, and winter having different patterns are prepared in advance, and the front panel 2 is replaced as necessary, the front panels 2 can be utilized as articles of the interior of a room which match the seasons.

Figure 13:
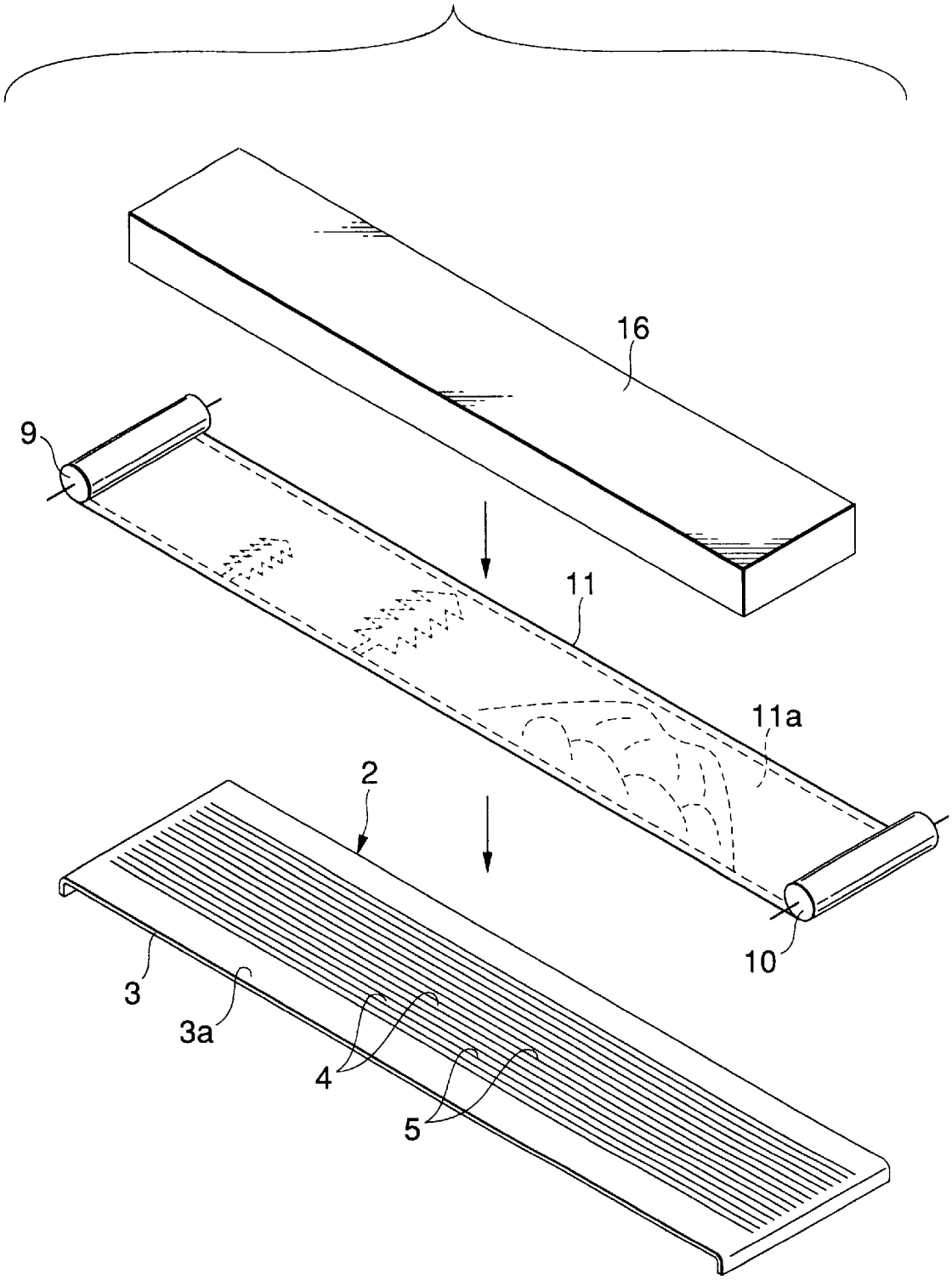
FIG. 13 is an exploded perspective view illustrating a method of reinforcing the front panel.
Figure 14A:
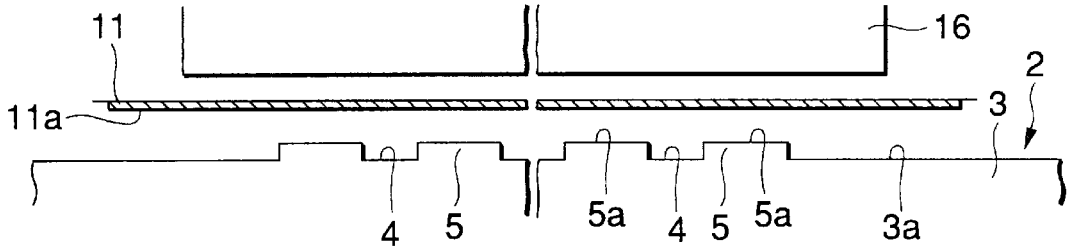
FIGS. 14(*a*)–14(*c*) are schematic side elevational views illustrating a procedure of the reinforcing method.
Figure 14B:
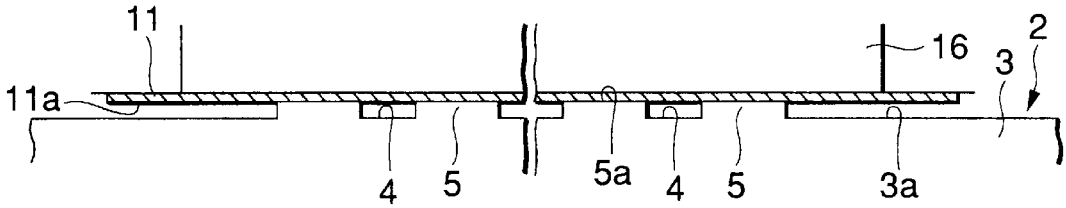
Figure 14C:
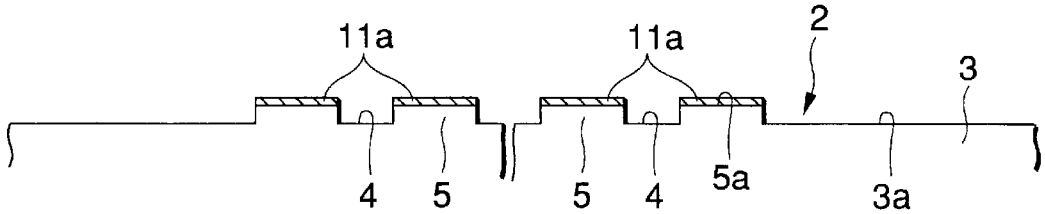

A method of reinforcing the front panel 2 will now be discussed with reference to FIGS. 13 and 14(*a*). In FIGS. 13 and 14(*a*), a release paper 11, stretched between a supply reel 9 and a takeup reel 10, is made to oppose the front surface 3*a* of the panel body 3. Then, as shown in FIG. 14(*b*), a heated heat transfer stamp (heating and pressure-contacting means) 16 is pressed against the front surface 3*a* of the panel body 3 via the release paper 11, thereby allowing the pattern (design)-incorporated protective sheet 11*a* on the release paper 11 to be heat transferred to the front surfaces 5*a* of the ribs 5. Subsequently, the release paper 11 is released from the front surface 3*a* of the panel body 3, thereby making it possible to obtain a front panel 2 in which the front surfaces 5*a* of the ribs 5 are reinforced and decorated by the protective sheet 11*a,* as shown in FIG. 14(*c*).

In accordance with the above-described arrangement, since the front surfaces 5*a* of the ribs 5 project slightly forward relative to the front surface 3*a* of the panel body 3, even if trimming masks 8 (see FIG. 16) are not used, the protective sheet 11*a* can be heat transferred only to the front surfaces of the ribs 5.

In the above-described arrangement, the protective sheet 11*a* is heat transferred to the front surfaces 5*a* ofthe ribs 5 by the heat transfer stamp 16. However, the present invention is not limited to this type of arrangement. For example, a heat transfer roll 12 (see FIG. 16) may be used instead of the heat transfer stamp 16. Further, the protective sheet 11*a* may be formed of a synthetic resin other than polypropylene or a metal foil such as an aluminum foil. As a result, in the case where the metal foil is used, the front surfaces 5*a* of the ribs 5 can be reliably reinforced, while, in the case of aluminum foil, since that material excels in flexibility, the protective sheet 11*a* can be reliably attached to the front surfaces 5*a* of the ribs. Further, the pattern-incorporated protective sheet 11*a* may be screen printed on the front surfaces 5*a* of the ribs 5. Moreover, although an arrangement in which the front surfaces 5*a* of the ribs 5 between the slits 4 for suction merely project forwardly is known from Japanese Patent Application Laid-Open No. Sho. 54-71841 and the like, no arrangement has been made in which a protective sheet is provided on the front surfaces 5*a* of the ribs 5. Also, there has been no air conditioner in which protection of the front surfaces 5*a* of the ribs 5 has been taken into consideration.

In accordance with the above-described embodiments of the invention, because the front surfaces of the ribs between the slits project slightly forward relative to the front surface of the panel body, the protective sheet can be simply attached only to the front surfaces of the ribs by heat transfer or the like. Since it is unnecessary to use trimming masks, fabrication is not troublesome, the number of processes can be reduced, and production cost can be lowered.

Also, by virtue of the design provided on the protective sheet, the front panel can be used as an article of the interior of a room. More specifically, the front panel provided with the design is arranged to be detachable with respect to the main body, and the front panel is changed, as necessary, to a panel provided with a design suitable for the season with a change in the season, or the front panel is changed to a panel suitable for the atmosphere of a room where the air conditioner is installed.

Moreover, it for example, a plurality of kinds of front panels 2 for spring, summer, fall, and winter having different patterns are prepared in advance, and the front panel is replaced as necessary, the front panels can be utilized as articles of the interior of a room which match the seasons. Again, this will provide visual cues imparting feelings of warmth or coolness on the part of users, thereby augmenting the effect of the selected operating mode (warming or cooling).

Furthermore, a synthetic resin sheet can be securely integrated with the front surfaces of the ribs by heat transfer, thereby reinforcing the ribs. Also, since the polypropylene-made sheet excelling in mechanical strength is heat transferred to the front surfaces of the ribs, when the ribs are cleaned with a brush or the like, the front surfaces of the ribs can be protected from becoming scored or damaged.

In addition, a transfer sheet with a designed picture printed on one side thereof in advance is interposed between the front panel and a heat transfer roller, and as the heat transfer roller is rolled while being brought into pressure contact with the transfer sheet, the designed picture on the transfer sheet is transferred only to the horizontal rib portions of the front panel.

Additionally, as discussed above, the front surfaces of the ribs can be reliably reinforced by metal foil. For example, aluminum foil, which excels in flexibility, can be reliably attached to the front surfaces of the ribs.

Moreover, even if trimming masks are not used, the protective sheet can simply be heat transferred to the front surfaces of the ribs by merely pressing the protective sheet against the front surfaces of the ribs by the heating and pressure-contacting means.

It will be apparent to those skilled in the art that various modifications and variations can be made in the air conditioner apparatus of the present invention without departing from the spirit or scope of the invention. Thus, it is intended that the present invention cover the modifications and variations of this invention provided they come within the scope of the appended chains and their equivalents.

We claim:

1. An air conditioner system including an air conditioner unit having a first operating mode in which the air conditioner unit is operated to effect one of cooling and heating, and a second operating mode in which the air conditioner unit is operated to effect the other of cooling and heating, the air conditioner system comprising:

a main body of the air conditioner unit, the main body comprising a casing accommodating a heat exchanger, a fan, and electrical parts; and a first graphic-bearing panel detachably fitted to the front surface of the main body of the air conditioner unit, the first graphic-bearing panel comprising a plurality of ribs forming slits penetrating from an obverse surface of the first panel to a reverse surface of the first panel, and displaying a first visual cue of one of coolness and warmth on the horizontal ribs, the first visual cue of the first graphic-bearing panel matching the effect provided by the first operating mode.

2. The air conditioner system of claim 1, further comprising:

a second graphic-bearing panel configured to be detachably fitted to the front surface of the main body of the air conditioner unit in replacement of the first graphic-bearing panel, the second graphic-bearing panel comprising a plurality of ribs forming slits penetrating from an obverse surface of the second panel to a reverse surface of the second panel, and displaying a second visual cue of the other of coolness and warmth on the horizontal ribs, the second visual cue of the second graphic-bearing panel matching the effect provided by the second operating mode.

3. The air conditioner system of claim 2, wherein the effect provided by the first operating mode is cooling, the first visual cue is one of coolness, the effect provided by the second operating mode is warming, and the second visual cue is one of warmth.

4. A method of optimizing an air conditioner structure by periodically modifying the structure of the air conditioner based on environmental conditions, the method comprising the steps of:

selecting a first operating mode of the air conditioner, dependent upon ambient conditions, in order to effect one of cooling and warming;

selecting a first graphic-bearing panel having a plurality of ribs forming slits penetrating from an obverse surface of the first panel to a reverse surface of the first panel, and displaying a first visual cue of one of coolness and warmth on the horizontal ribs of the first graphic-bearing panel, the selecting of the first operating mode and the first graphic-bearing panel being performed so that the first visual cue of the first graphic-bearing cover matches the effect provided by the first operating mode;

disposing the first graphic-bearing panel on an externally visible portion of the air conditioner;

selecting a second operating mode of the air conditioner, dependent upon ambient conditions, in order to effect the other of cooling and warming;

selecting a second graphic-bearing panel having a plurality of ribs forming slits penetrating from an obverse surface of the second panel to a reverse surface of the second panel, and displaying a second visual cue of the other of coolness and warmth on the horizontal ribs of the second graphic-bearing panel, the selecting of the second operating mode and the second graphic-bearing panel being performed so that the second visual cue of the second graphic-bearing panel matches the effect provided by the second operating mode; and replacing the first graphic-bearing panel on the externally visible portion of the air conditioner with the second graphic-bearing cover.

5. The method of claim 4, wherein the selecting of the first operating mode is performed in order to effect cooling by the air conditioner, the selecting of the first graphic-bearing panel is performed in order to display a first visual cue of coolness, the selecting of the second operating mode is performed in order to effect warming by the air conditioner;

and the selecting of the second graphic-bearing panel is performed in order to display a second visual cue of warmth.

6. The method of claim 4, wherein the selecting of the first operating mode is performed in order to effect warming by the air conditioner, the selecting of the first graphic-bearing panel is performed in order to display a first visual cue of warmth, the selecting of the second operating mode is performed in order to effect cooling by the air conditioner, and the selecting of the second graphic-bearing panel is performed in order to display a second visual cue of coolness.

7. A front panel having an entire portion thereof formed of a resin molding and being configured to be detachably supported on a main body of an air conditioner, the front panel comprising:

a plurality of horizontal ribs forming slits penetrating from an obverse surface of the front panel to a reverse surface of the front panel; and a picture pattern physically printed on the horizontal ribs of the front panel.

8. The air conditioner front panel of claim 7, wherein the printed picture pattern forms a protective layer on a surface of the horizontal ribs.

9. The air conditioner front panel of claim 7, wherein the printed picture pattern psychically reinforces and strengthens the horizontal ribs against breakage.

10. The air conditioner front panel of claim 7, wherein a portion of a cross section of each of the horizontal ribs is rectangular, and at least a portion of the picture pattern is printed on a front side of at least one of the rectangular portions of the ribs such that the picture pattern is externally visible during normal air conditioner usage.

11. The air conditioner front panel of claim 7, wherein the front panel is rotatable and detachable with respect to the main body of the air conditioner via a hinge portion of the front panel projecting from a side of the front panel.

12. The air conditioner front panel of claim 7, wherein the picture pattern is a film-heat-transfer-printed picture pattern.

13. The air conditioner front panel of claim 7, wherein the picture pattern is a hot-stamp-printed picture pattern.

14. The air conditioner front panel of claim 7, wherein the picture pattern is a silk-screen-printed picture pattern.

15. The air conditioner front panel of claim 7, wherein the plural slits are for suction and formed in parallel with each other at predetermined intervals, front surfaces of the ribs project slightly forward relative to a main front surface of the panel, and a protective sheet is attached to the front surfaces of the ribs.

16. The air conditioner front panel of claim 15, wherein the picture pattern is provided on the protective sheet.

17. The air conditioner front panel of claim 15, wherein the protective sheet is a synthetic resin sheet heat transferred to the front surfaces of the ribs.

18. The air conditioner front panel of claim 15, wherein the protective sheet is a polypropylene sheet.

19. The air conditioner front panel of claim 15, wherein the protective sheet is a metal foil attached to the front surfaces of the ribs.

20. The air conditioner front panel of claim 15, wherein the protective sheet is an aluminum foil sheet.

21. The air conditioner front panel of claim 7, wherein the picture pattern comprises a visual cue of one of coolness and warmth matching an effect provided by the air conditioner when in one of a cooling mode and a warming mode, respectively.

* * * * *